United States Patent [19]

Neuhalfen

[11] Patent Number: 5,020,156

[45] Date of Patent: Jun. 4, 1991

[54] BASEBALL CATCHER'S CHEST PROTECTOR

[75] Inventor: Mark Neuhalfen, Villa Park, Ill.

[73] Assignee: Wilson Sporting Goods Co., River Grove, Ill.

[21] Appl. No.: 436,221

[22] Filed: Nov. 14, 1989

[51] Int. Cl.[5] ..... A41D 13/00

[52] U.S. Cl. ..... 2/2; 2/2.5; 2/92

[58] Field of Search ..... 2/92, 2, 16, 48, 49 R, 2/51, 2.5; D29/9, 10; 273/26 C

[56] References Cited

U.S. PATENT DOCUMENTS

| | | | |
|---|---|---|---|
| D. 296,595 | 7/1988 | Flosi et al. | D29/10 |
| D. 300,376 | 3/1989 | Tellini | D29/10 |
| 2,001,508 | 5/1935 | Tobin | 2/2 |
| 2,640,987 | 6/1953 | Ehlers | D29/10 |
| 2,990,549 | 7/1961 | Doughty | 2/2 |
| 3,088,115 | 5/1963 | Groot | 2/2 |
| 3,514,786 | 6/1970 | Terwilliger | 2/2.5 |
| 4,084,264 | 4/1978 | Marion . | |
| 4,100,620 | 7/1978 | Pecoraro | 2/2 |
| 4,425,667 | 1/1984 | Harrison | 2/2 |
| 4,467,475 | 8/1984 | Gregory et al. | 2/2 |
| 4,481,679 | 11/1984 | Hayes . | |
| 4,514,862 | 5/1985 | A'Costa . | |
| 4,525,875 | 7/1985 | Tomczak . | |
| 4,590,622 | 5/1986 | Wolfe et al. | 2/2 |
| 4,847,913 | 7/1989 | Chen | 2/92 |

OTHER PUBLICATIONS

Wilson 1988 catalog p. 58.

*Primary Examiner*—William A. Cuchlinski, Jr.
*Assistant Examiner*—Alvin Wirthlin

[57] ABSTRACT

A baseball catcher's chest protector includes a main pad adapted to cover the chest, stomach, and shoulders of the catcher, and a shoulder pad adapted to cover one shoulder and the upper portion of one arm of the catcher. The shoulder pad is hingedly and removably attached to the main pad by flexible straps. The main pad is provided with generally diagonally extending hinge lines to permit the pad to conform to the body of the catcher.

4 Claims, 2 Drawing Sheets

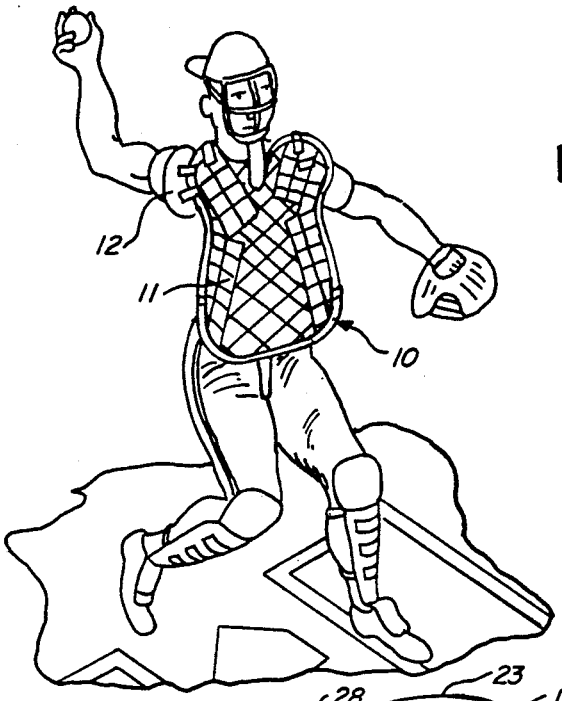
FIG. 1
FIG. 2
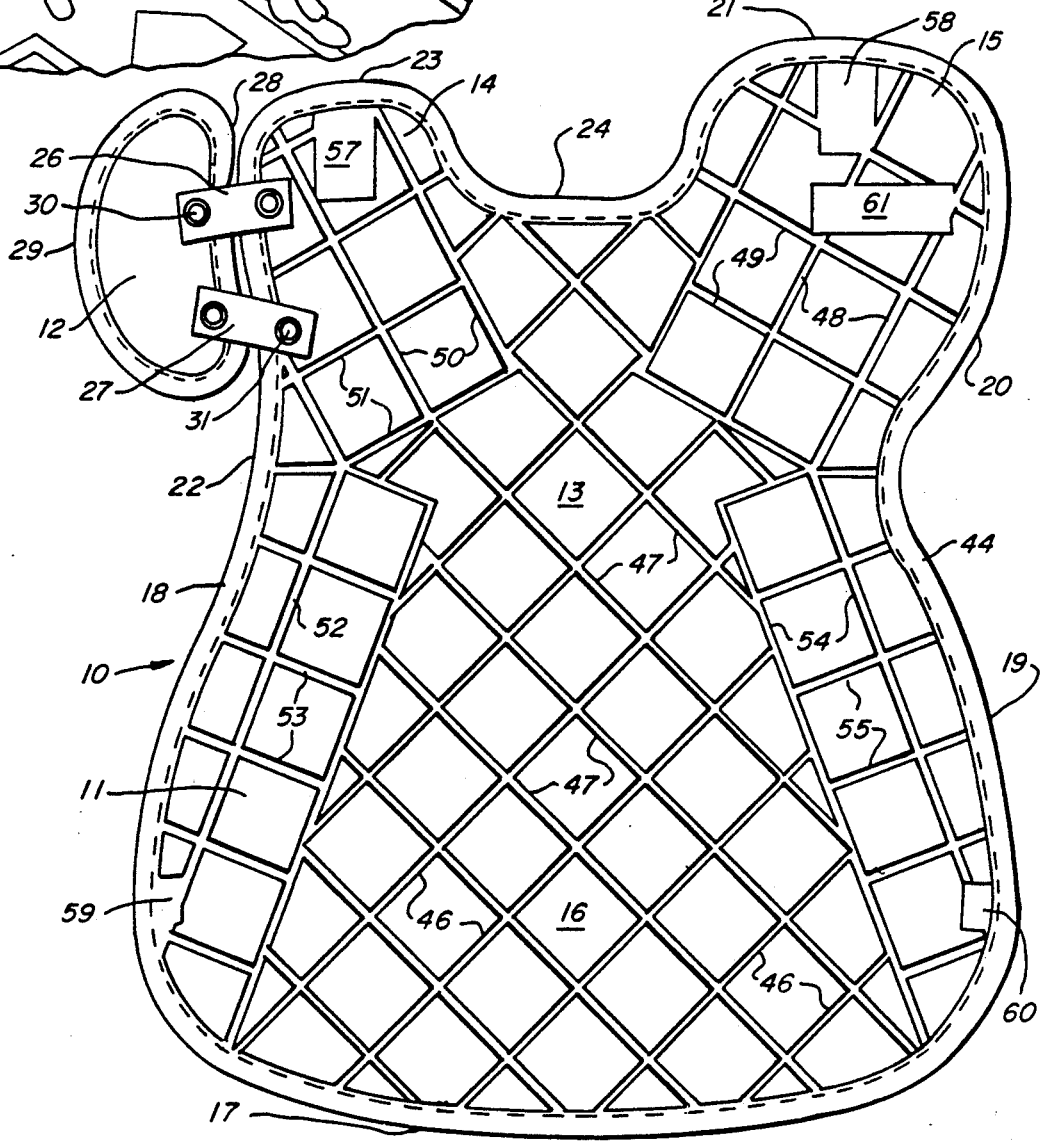

FIG. 3
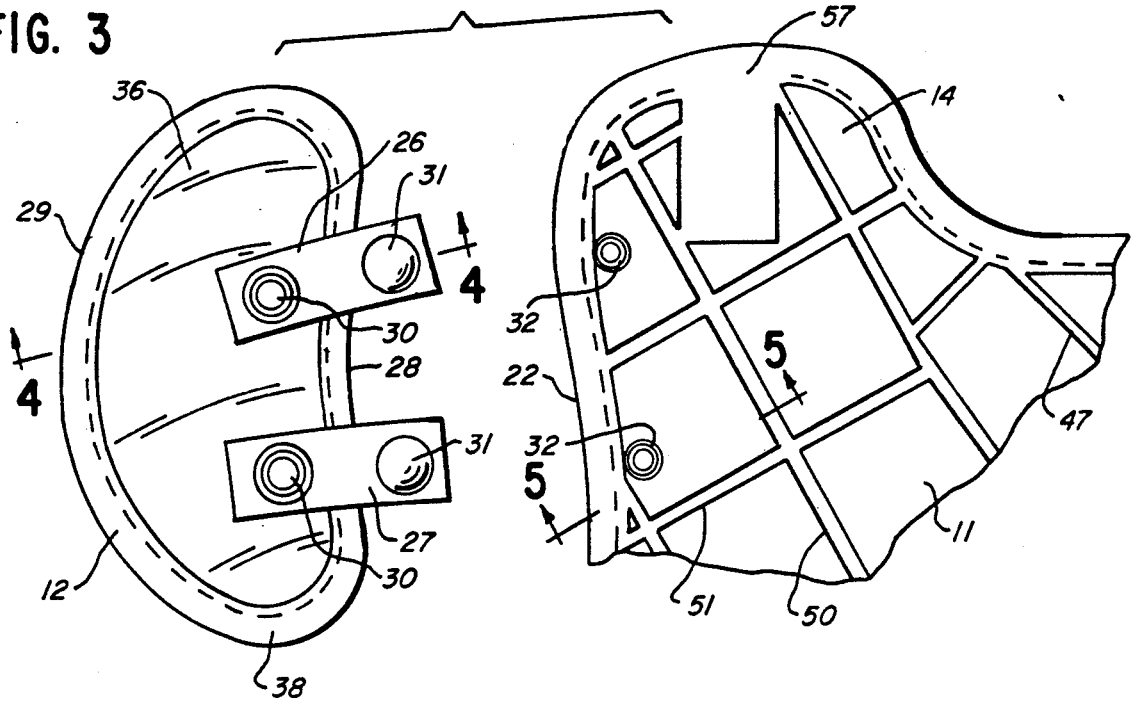
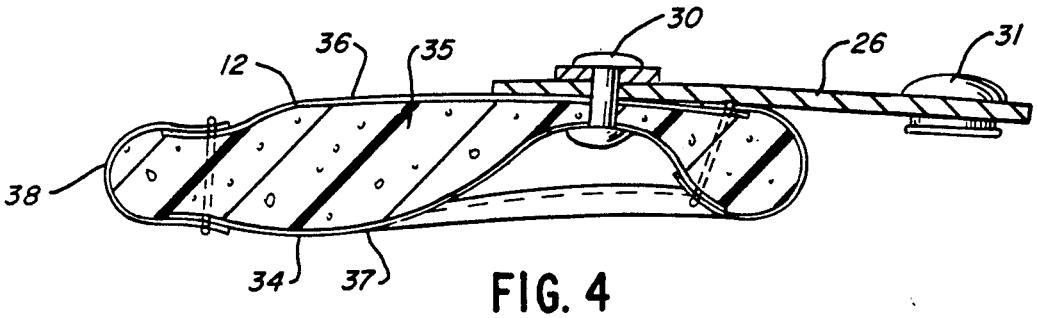
FIG. 4
FIG. 5
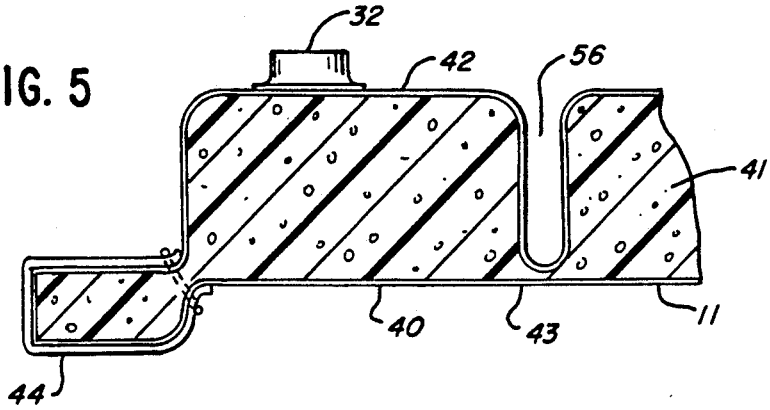

BASEBALL CATCHER'S CHEST PROTECTOR

BACKGROUND AND SUMMARY

This invention relates to a baseball catcher's chest protector, and, more particularly, to a chest protector which includes a detachable shoulder pad for protecting the shoulder of the throwing arm and hinge lines for permitting the chest protector to conform to the body of the catcher.

Baseball chest protectors have been designed to protect the upper body as much as possible without restricting the catcher's mobility or throwing ability. Because of these design restrictions, the right shoulder on a right-handed catcher is unprotected from stray balls. On many occasions a right-handed catcher is hit on the right shoulder or upper right arm. The same can be said for left-handed catchers.

The mobility of the catcher is improved by providing the chest protector with hinge areas which permit the protector to flex and to conform to the catcher's body. Traditionally, the hinge areas extend generally horizontally and vertically.

The invention provides a chest protector with a shoulder pad which is hingedly and removably attached to the protector for protecting the shoulder of the throwing arms without interfering with the catcher's throwing motion. The shoulder pad can be removed if the catcher does not want to use it. The chest protector includes uniquely arranged hinge lines which provide increased flexiblity and conformability, thereby increasing the catcher's comfort and mobility.

DESCRIPTION OF THE DRAWING

The invention will be explained in conjunction with an illustrative embodiment shown in the accompanying drawing, in which FIG. 1 is a perspective view of a baseball catcher wearing a chest protector formed in accordance with the invention;

FIG. 2 is a plan view of the chest protector;

FIG. 3 is an enlarged fragmentary exploded view of the removable shoulder pad and right shoulder portion of the chest protector;

FIG. 4 is a sectional view taken along the line 4—4 of FIG. 3; and

FIG. 5 is a sectional view taken along the line 5—5 of FIG. 3.

DESCRIPTION OF SPECIFIC EMBODIMENT

Referring to FIGS. 1 and 2, the numeral 10 designates generally a baseball catcher's chest protector which includes a main pad 11 and a shoulder pad 12. The main pad includes a chest portion 13, right and left shoulder portions 14 and 15, and a stomach portion 16 which are adapted to cover the chest, shoulders, and stomach of the catcher.

The stomach portion includes a bottom edge 17 and side edges 18 and 19. The left shoulder portion includes an outwardly and upwardly curved side edge 20 and a top edge 21. The right shoulder portion includes a side edge 22 which curves only slightly outwardly and a top edge 23. The chest portion includes a U-shaped top edge 24 which covers the neck and extends upwardly on both sides of the head.

The particular chest protector illustrated is for a right-handed catcher, and the left shoulder portion is larger than the right shoulder portion. Since the left arm is not used for throwing, the left shoulder portion can cover the left shoulder and the upper left arm without interfering with the catcher's throwing motion.

The right shoulder portion is shaped so that the chest protector will not interfere with the throwing motion of the right arm. Conventional chest protectors therefore leave a portion of the right shoulder and the upper right arm exposed, and the shoulder and arm can be hit by foul balls.

The shoulder pad 12 covers the right shoulder and upper right arm and provides substantially the same protection as the left shoulder portion 15. However, the shoulder pad is hingedly attached to the main pad by a pair of flexible straps 26 and 27 so that the shoulder pad can flex freely when the catcher is throwing as illustrated in FIG. 1. The particular pad illustrated is kidney shaped and includes a concavely curved inside edge 28 which conforms to the shape of the right shoulder portion 14 and a convexly curved outside edge 29.

The flexible straps 26 and 27 are made of leather or other suitable material and are secured to the shoulder pad 12 by rivets 30. The inside ends of the straps are removably attached to the chest protector by female snap fasteners 31 on the straps and male strap fasteners 32 (FIGS. 3 and 5) on the chest protector. If the catcher does not want to use the shoulder pad, the shoulder pad can be removed simply by unsnapping the snap fasteners.

Referring to FIG. 4, the shoulder portion 12 includes an outer casing 34 and a cushion 35 of shock-absorbent foam material such as polyethylene or polyurethane. The casing 34 includes top and bottom layers 36 and 37 of fabric such as nylon or polyester knit, and an edge binding 38 which is stitched to the fabric.

Referring to FIG. 5, the main pad 11 similarly includes an outer casing 40 and a shock-absorbent cushion 41 of polyethylene foam. The casing includes a top layer 42 of nylon or Spandex fabric, a bottom layer 43 of polyester knit fabric, and an edge binding 44 which is stitched to the top and bottom layers.

The chest and stomach portions 13 and 16 of the main pad are provided with first and second sets of diagonally extending hinge lines 46 and 47. The hinge lines 46 are parallel and extend from the lower right portion of the pad upwardly to the upper left portion of the pad. The hinge lines 47 extend generally perpendicularly to the hinge lines 46 and extend from the lower left portion of the pad to the upper right portion of the pad. Hinge lines 48 extend generally diagonally upwardly in the left shoulder portion at a slight angle to the hinge lines 46, and hinge lines 49 extend perpendicularly to the hinge lines 48. Similarly, hinge lines 50 extend generally diagonally upwardly in the right shoulder portion at a slight angle to the hinge lines 47, and hinges 51 extend perpendicularly to the hinge lines 50.

The right side of the stomach portion of the pad is provided with a pair of generally upwardly extending hinge lines 52 which are inclined slightly from the vertical. Hinge lines 53 extend perpendicularly to the hinge lines 52. The left side of the stomach portion is provided with similar generally upwardly extending hinge lines 54 which are inclined slightly from the vertical and hinge lines 55 which extend perpendicularly to the hinge lines 54.

Referring to FIG. 5, the hinge lines are formed by heating the cushion 41 and the fabric casing 40 and pressing the top of the pad with a press which has downwardly extending ribs which form valleys 56 in the cushion 41. The ribs force the top fabric 42 downwardly in the valleys so that the top fabric is closely adjacent the bottom fabric 43, and any cushion which remains between the fabric layers offers little or no resistance to bending or flexing. The top fabric layer can also be heat sealed to the polyethylene cushion 41 so that the fabric retains the shape which is pressed into it.

The press also forms flat areas 57 and 58 in the right and left shoulder portions (FIG. 2) and flat areas 59 and 60 in the lower right and left sides of the pad. The cushion is squeezed out of the flat areas so that tabs can be attached to the pad for holding the straps which secure the pad to the catcher. Another flat area 61 may be formed in the left shoulder for a trademark or logo.

The intersecting hinge lines form squares of cushion material which are bounded on four sides by hinge lines. The pad can flex freely along the hinge lines, and the pad readily adapts to the shape of the catcher's body. The hinge lines also increase the catcher's mobility and throwing ability by flexing as the body moves. The hinge lines are oriented to provide maximum flexibility and motion.

Conventional chest protectors are provided with hinge lines which extend horizontally and vertically. However, the generally diagonal and multiple directioned hinge lines described herein provide greater flexibility and mobility.

The chest protector illustrated in the drawings is designed for right-handed catchers. A left-handed catcher would use a chest protector which is the mirror image of the chest protector illustrated in FIG. 2. The shoulder pad 12 would be attached to the left shoulder portion of the chest protector.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A baseball catcher's chest protector comprising a one piece substantially flat pad formed by an outer casing and a shock-absorbent cushion within the outer casing, the protector having a chest portion, a stomach portion, and right and left shoulder portions which are formed in one piece for covering the chest, stomach, and shoulders, respectively of a wearer, the cushion being provided with a first set of generally parallel hinge lines which extends from the lower right portion of the stomach portion to the left shoulder portion and a second set of generally parallel hinge lines which extends from the lower left stomach portion to the right shoulder portion and which intersect the first set of hinge lines wherein the cushion can flex about said hinge lines and conform to the body of a wearer, the hinge lines being provided by valleys in the cushion.

2. The chest protector of claim 1 in which the cushion includes right and left side portions which extend downwardly from the right and left shoulder portions, the cushion having a third set of hinge lines which extend generally vertically within the right side portion and a fourth set of hinge lines which extends generally perpendicularly to the third set of hinge lines, a fifth set of hinge lines which extends generally vertically within the left side portion, and a sixth set of hinge lines which extend generally perpendicularly to the fifth set of hinge lines, the hinge lines being provided by valleys in the cushion.

3. The chest protector of claim 2 including a seventh set of hinge lines in the left shoulder portion which extends more vertically than the first set of hinge lines and an eighth set of hinge lines in the left shoulder portion which extend generally perpendicularly to the seventh set of hinge lines, a ninth set of hinge lines in the right shoulder portion which extends more vertically than the second set of hinge lines, and a tenth set of hinge lines in the right shoulder portion which extend generally perpendicularly to the ninth set of hinge lines, the hinge lines being provided by valleys in the cushion.

4. The chest protector of claim 3 in which the casing includes inner and outer layers which are secured together around their peripheries, the outer layer extending inwardly toward the inner layer along the hinge lines.

* * * * *